United States Patent [19]

Sugita et al.

[11] Patent Number: 4,931,383

[45] Date of Patent: Jun. 5, 1990

[54] SILVER HALIDE PHOTOGRAPHIC LIGHT-SENSITIVE MATERIAL

[75] Inventors: Shuichi Sugita, Hachioji; Satoshi Nakagawa, Sagamihara; Naoko Shimada, Tokyo, all of Japan

[73] Assignee: Konica Corporation, Tokyo, Japan

[21] Appl. No.: 226,921

[22] Filed: Aug. 1, 1988

[30] Foreign Application Priority Data

Aug. 2, 1987 [JP] Japan ..... 62-193136

[51] Int. Cl.[5] ..... G03C 7/38

[52] U.S. Cl. ..... 430/551; 430/558

[58] Field of Search ..... 430/551, 558

[56] References Cited

U.S. PATENT DOCUMENTS 4,675,275 6/1987 Nishijima et al. ..... 430/372

FOREIGN PATENT DOCUMENTS 0185506 6/1986 European Pat. Off. .

0187521 7/1986 European Pat. Off. .

*Primary Examiner*—Paul R. Michl

*Assistant Examiner*—Mark R. Buscher

*Attorney, Agent, or Firm*—Finnegan, Henderson, Farabow, Garrett and Dunner

[57] ABSTRACT

Silver halide color photographic light-sensitive material is disclosed, which is improved in color reproducibility and in fastness of magenta images to light, heat and humidity. The photographic material a magenta coupler represented by Formula (M-1) and a compound represented by Formula (XI) or Formula (XII).

Formula (M-1)

Formula (XI)

Formula (XII)

In formulas (XI) and (XII) $X^1$ is an oxygen atom, a sulfur atom or an $—NR^{10}—$; $X^2$ represents a hydroxyl sulfur atom; $R^6$ and $R^7$ each represent a substituent having a $\sigma$ p value of not more than $-0.25$; M represents a metal atom; and a and b each represent an integer of 0 to 3.

11 Claims, No Drawings

SILVER HALIDE PHOTOGRAPHIC LIGHT-SENSITIVE MATERIAL

FIELD OF THE INVENTION

The present invention relates to a silver halide photographic light-sensitive material, and more particularly it is concerned with a silver halide photographic light-sensitive material improved in color-reproducibility.

BACKGROUND OF THE INVENTION

Methods for forming a color image with use of silver halide photographic light-sensitive materials may included a method in which a photographic coupler is reacted with an oxidized product of a color developing agent to form a color image, and commonly used as the photographic coupler to perform usual color-reproduction are magenta, yellow and cyan couplers, and as the color developing agent, an aromatic primary amine color developing agent, respectively, where the magenta and yellow couplers are each reacted with an oxidized product of the aromatic primary amine color developing agent to form dye images such s azomethine dyes, and the cyan coupler is reacted with an oxidized product of the aromatic primary amine color developing agent to form a dye such as indoaniline dyes.

Among these, used for the formation of the magenta dye image are 5-pyrazolone, cyanoacetophenone, indazolone, pyrazolobenzimidazole and pyrazolotriazole couplers.

Almost all of those hitherto practically used as couplers for the formation of the magenta dye image have been 5-pyrazolone couplers. Dye images formed from the 5-pyrazolone couplers have superior fastness to light and heat. However, they have no sufficient color tone of the dyes, allow the presence of unnecessary absorption having a yellow component in the vicinity of 430 nm, and also have a broade absorption spectrum near 550 nm, thus causing color contamination and resulting in lack of clearness of photographic images.

Particularly superior as the couplers free of this unnecessary absorption includes 1H-pyrazolo[3,2-c]-s-triazole couplers, 1-H-imidazo[1,2-b]-pyrazole couplers, and 1-H-b-pyrazolo[1,5-b]-pyrazole couplers or 1-H-b-pyrazolo[1,5-d]-tetrazole couplers, described in U.S. Pat. No. 3,725,067, Japanese patent Publications Open to Public Inspection (hereinafter referred to as Japanese Patent O.P.I. Publications) No. 162548/1984, No. 171956/1956, etc..

However, the dye images to be formed from these couplers have very low fastness to light. Employment of these couplers in light-sensitive materials, particularly in light-sensitive materials suited for direct viewing, may result in impairment of the essential condition for photographic materials that the images must be recorded and stored.

Accordingly, there have been involved in difficulties in putting them into practical use. Then Japanese Patent O.P.I. Publication No. 125732/1984 discloses that a phenol or phenol ether type antioxidant is used as a measure to improve light-fastness, but no sufficient effect has ever been achieved.

Also, the chelate described in Japanese Patent O.P.I. Publication No. 140941/1986 can remarkably improve the light-fastness, but can be said to be sufficient because of generation of yellow stains.

SUMMARY OF THE INVENTION

A first object of the present invention is to provide a silver halide photographic light-sensitive material having superior fastness to light of magenta dye images.

A second object of the present invention is to provide a silver halide photographic light-sensitive material improved in the fastness to light of the magenta dye image formed from at least one of the above couplers, and free of any deterioration in the photographic performances such as speed, gradation and whiteness.

A third object of the present invention is to provide a silver halide photographic light-sensitive material improved in the color reproduction quality of magenta dye images also having good fastness to light of magenta dye images.

The above objects of the present invention can be achieved by a silver halide photographic light-sensitive material having at least one silver halide emulsion layer, wherein said material comprises at least one coupler represented by the following Formula (M-I) and at least one compound selected from the group consisting of compounds represented by the following Formula (XI) and compounds represented by the following Formula (XII);

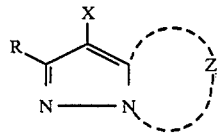

Formula (M-I)

wherein

Z represents a group of non-metal atoms necessary to complete a nitrogen-containing heterocyclic ring, which may have a substituent;

X represents a hydrogen atom or a substituent capable of being split off upon reaction with the oxidized product of a color developing agent; and R represents a hydrogen atom or a substituent.

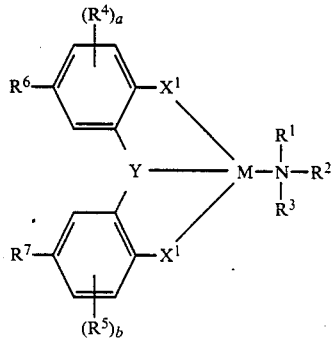

Formula (XI)

-continued

Formula (XII)

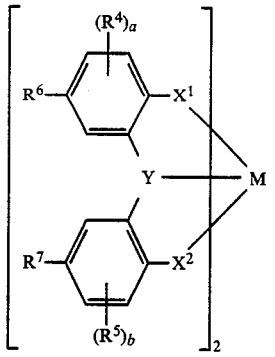

wherein $X^1$ is an oxygen atom, a sulfur atoms, or —$NR^{10}$— in which $R^{10}$ represents a hydrogen atom, an alkyl group, an aryl group or a hydroxyl group;

$X^2$ represents a hydroxyl group or a mercapto group;

Y represents an oxygen atom or a sulfur atom;

$R^1$, $R^2$ and $R^3$ each represent a hydrogen atom, an alkyl group or an aryl group, provided that at least two of the groups represented by $R^1$, $R^2$ and $R^3$ are each an alkyl group or an aryl group;

$R^4$ and $R^5$ each represent a substituent;

$R^6$ and $R^7$ each represent a substituent having $\sigma p$ value of not more than −0.25;

$R^4$, $R^5$, $R^6$ or $R^7$ adjacent each other may form a ring of five-members or six-members;

M represents a metal atom; and a and b each represent an integer of 0 to 3.

DETAILED DESCRIPTION OF THE INVENTION

In the magenta coupler represented by the above Formula (M-I),

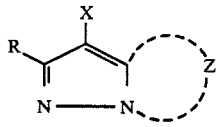

usable as the substituent represented by R may include various ones without any particular limitation, but may typically include an alkyl group, an aryl group, an anilino group, an acylamino group, a sulfonamide group, an alkylthio group, an arylthio group, an alkenyl group, a cycloalkyl group, a halogen atom, a cycloalkenyl group, an alkynyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclic oxy group, a siloxy group, an acyloxy group, a carbamoyloxy group, an amino group, an alkylamino group, an imido group, an ureido group, a sulfamoylamino group, an alkoxycarbonylamino group, an aryloxycarbonylamino group, an alkoxycarbonyl group, an aryloxycarbonyl group, a heterocyclic thio group, a spiro compound residual group, and a bridged hydrocarbon compound residual group.

The above alkyl group may preferably include those having 1 to 32 carbon atoms, which may be either straight-chain or branched.

The alkenyl group may preferably include those having 2 or 32 carbon atoms; and the cycloalkyl group, those having 3 to 12 carbon atoms, particularly 5 to 7 carbon atoms. The alkenyl group may be either straight-chain or branched.

The cycloalkenyl group may preferably include those having 3 to 12 carbon atoms, particularly 5 to 7 carbon atoms.

The aryl group may preferably include a phenyl group.

Also, the acylamino group may include an alkylcarbonylamino group and an arylcarbonylamino group;

the sulfonamido group, an alkylsulfonylamino group, an arylsulfonylamino group;

the sulfonyl group, an alkylsulfonyl group and an arylsulfonyl group;

the sulfinyl group,an alkylsulfinyl group and an arylsufinyl group;

the phosphonyl group, an alkylphosphonyl group, an alkoxyphosphonyl group, an aryloxyphosphonyl group and an arylphosphonyl group;

the acyl group, an alkylcarbonyl group and an arylcarbonyl group;

the carbamoyl group, an alkylcarbamoyl group and an arylcarbamoyl group;

the sulfamoyl group, an alkylsulfamoyl group and an arylsulfamoyl group;

the acyloxy group, an alkylcarbonyloxy group and arylcarbonyloxy group;

the carbamoyloxy group, an alkylcarbamoyloxy group and an arylcarbamoyloxy group;

the ureido group, an alkylureido group and an arylureido group; and the sulfamoylamino group, an alkylsulfamoylamino group and an arylsulfamoylamino group.

The heterocyclic ring may preferably include those of 5 to 7 members, specifically including a 2-furyl group, a 2-thienyl group, 2-pyrimidinyl group and 2-benzothiazolyl group.

The heterocyclic oxy group may preferably include those having a heterocyclic ring of 5 to 7 members, including, for example, a 3,4,5,6-tetrahydropyranyl-2-oxy group and 1-phenyltetrazole-5-oxy group.

The heterocyclic thio group may preferably include a heterocyclic thio group of 5 to 7 members, including, for example, a 2-pyridylthio group, a 2-benzothiazolylthio group and a 2,4-diphenoxy-1,3,5-triazole-6-thio group.

Also, the siloxy group may preferably include a trimethylsiloxy group, a triethylsiloxy group and a dimethylbutylsiloxy group;

the imido group, a succinimido group, a 3-heptadecylsuccinimido group, a phthalimido group and a glutalimido group;

the spiro compound residual group, spiro[3.3]heptan-1-yl; and the bridged hydrocarbon compound residual group, bicylo[2.2.1]heptan-1-yl, tricyclo[3.3.1.1$^{3,7}$]decan-1-yl and 7,7-dimethyl-bicyclo[2.2.1]heptan-1-yl.

The group represented by X, capable of being split off through the reaction with an oxidized product of a color developing agent, may include, for example, a halogen atom such as a chlorine atom, a bromine atom or a fluorine atom, an alkoxy group, an aryloxy group, a heterocyclic oxy group, an acyloxy group, as sulfonyloxy group, an alkoxycarbonyloxy group, an aryloxycarbonyloxy group, an alkyloxalyloxy group, an alkoxyoxalyloxy group, an alkylthio group, an arylthio group, a heterocyclic thio group, an alkyloxythiocarbonylthio group, an acylamino group, a sulfonamido group, a nitrogen-containing heterocyclic group (bonded with a N atom), an alkyloxycarbonylamino group, an aryloxycarbonylamino group, a carboxyl group and

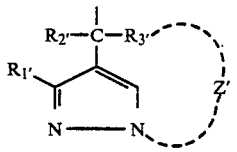

$R_1$ represents the same as the above R, and Z', the same as the above Z. $R_2$ and $R_3$ each represent a hydrogen atom, an aryl group, an alkyl group or a heterocyclic group, but preferably includes a halogen atom, particularly a chlorine atom.

The nitrogen-containing heterocyclic group formed by Z or Z' may include a pyrazole ring, an imidazole ring, a triazole ring or a tetrazole ring, and the substituent the above ring may have may include those described for the above R.

Formula (M-I) is more specifically represented by the following Formulas (M-II) to (M-VII).

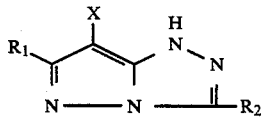

Formula (M-II)

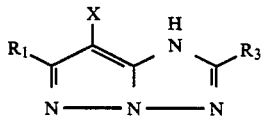

Formula (M-III)

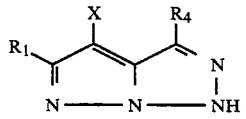

Formula (M-IV)

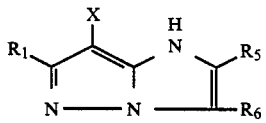

Formula (M-V)

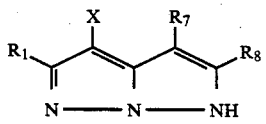

Formula (M-VI)

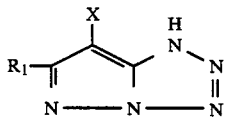

Formula (M-VII)

In the above Formula (M-II) to (M-VII), $R_1$ to $R_8$ and X represent the same as the above R and X.

Among Formula (M-I), preferred is the one represented by Formula (M-VIII) shown below.

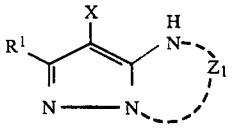

Formula (M-VIII)

wherein $R_1$, X and $Z_1$ represent the same as R, y and Z in Formula (M-I).

Among the magenta couplers represented by the above Formulas (M-II) to (M-VII), a particularly preferred magenta coupler is the magenta coupler represented by Formula (M-II).

Most preferred as the substituent R or $R_1$ on the above heterocyclic ring is a substituent represented by Formula (M-IX) shown below.

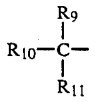

wherein $R_9$, $R_{10}$ and $R_{11}$ each represent the same as the above R.

Any two of the above $R_9$, $R_{10}$ and $R_{11}$, for example, $R_9$ and $R_{10}$, may also be combined to form a saturated or unsaturated ring as exemplified by cycloalkane, cycloalkene and a heterocyclic ring, and $R_{11}$ may further be combined to said ring to constitute a bridged hydrocabon compound residual group.

Particularly preferred in Formula (M-IX) are;

(i) the case when at least two of $R_9$ to $R_{11}$ each are an alkyl group; and (ii) the case when one of $R_9$ to $R_{11}$, for example, $R_{11}$, is a hydrogen atom, and other two, $R_9$ and $R_{10}$, are combined to form cycloalkyl together with the route hydrocarbon atom.

Further particularly preferred in (i) is the case when any two of $R_9$ to $R_{11}$ each are an alkyl group and the remaining one is a hydrogen atom or an alkyl group.

Also, the substituent the ring formed by Z in Formula (M-I) or the ring formed by $Z_1$ in Formula (M-VIII) may have, and $R_2$ to $R_8$ in Formulas (M-II) to (M-VI) may preferably include those represented by Formula (M-X) shown below.

$$-R^{12}-SO_2-R^{13}$$ Formula (M-X)

In the formula, $R^{12}$ represents an alkylene group, and $R^{13}$ represents an alkyl group, a cycloalkyl group or an aryl group.

The alkylene group represented by $R^{12}$ may preferably have two or more, more preferably 3 to 6, carbon atoms at the straight-chain moiety, regardless of being straight-chain or branched.

The cycloalkyl group represented by $R^{13}$ may preferably include those of 5 or 6 members.

Typical examples of the compounds according to the present invention are shown below.

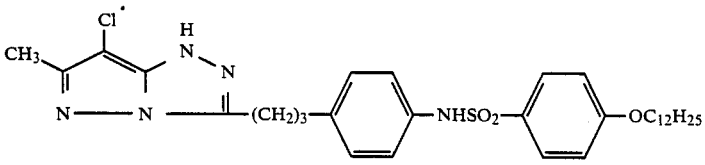

1

-continued
2
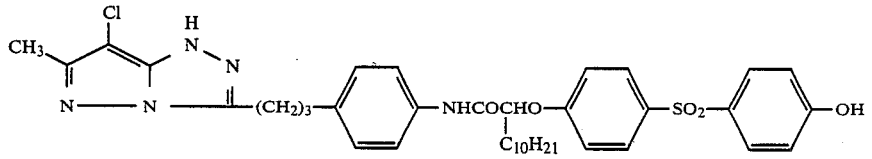
3
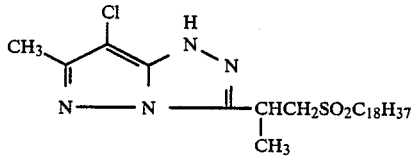
4
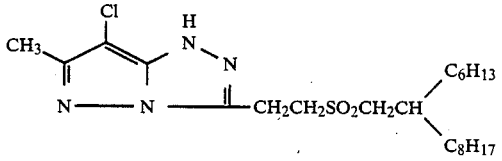
5
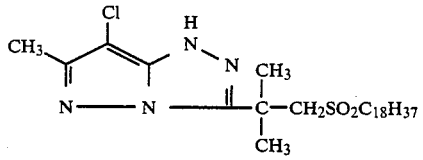
6
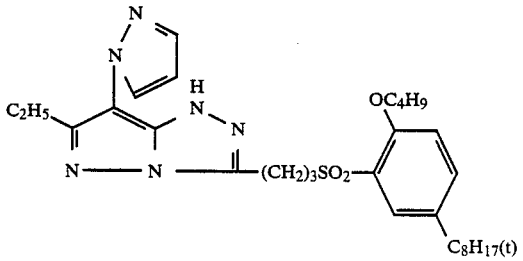
7
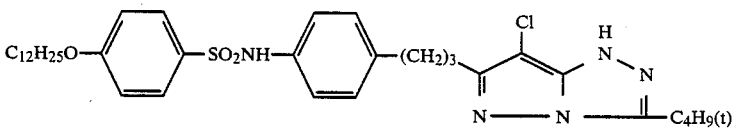
8
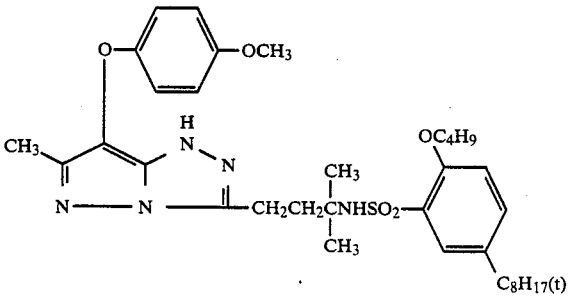
9
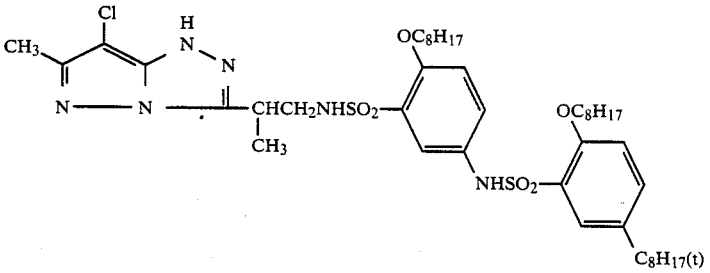

-continued
10
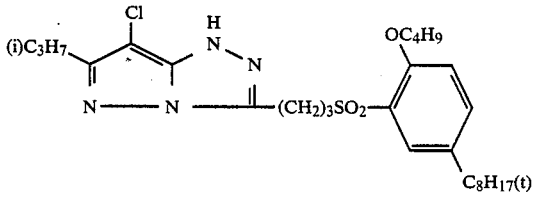
11
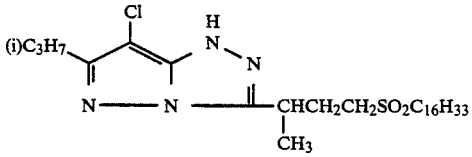
12
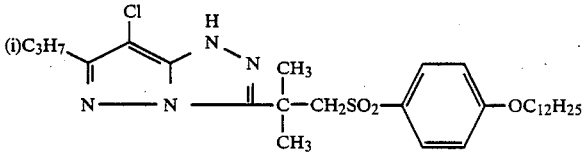
13
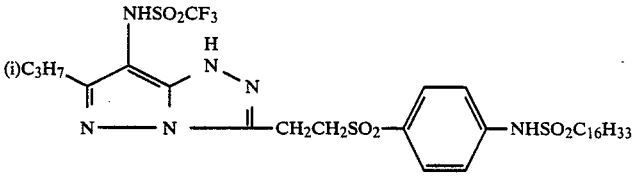
14
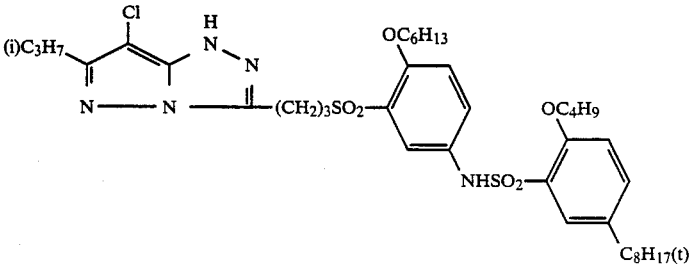
15
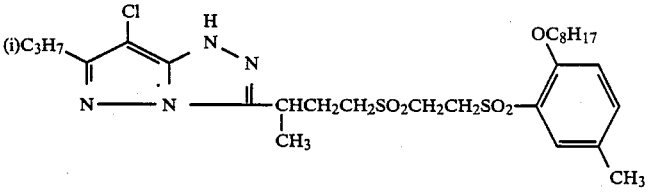
16
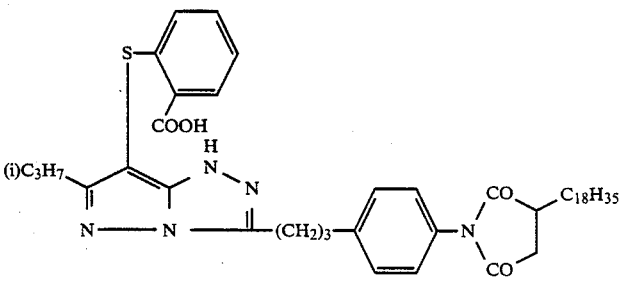
17
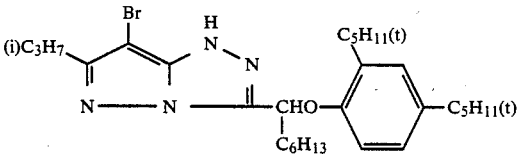

-continued
18
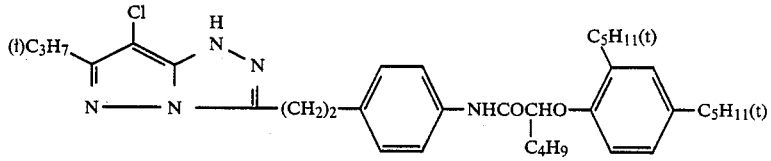
19
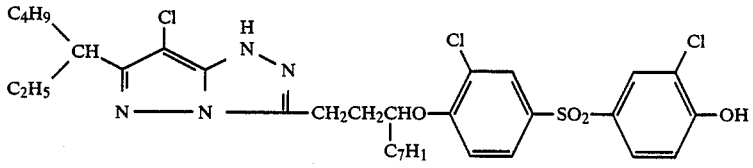
20
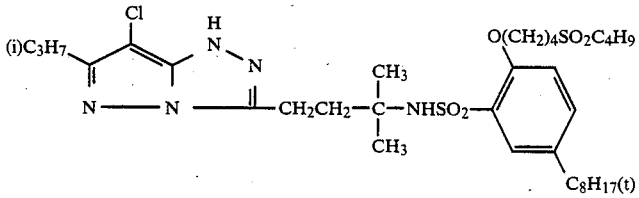
21
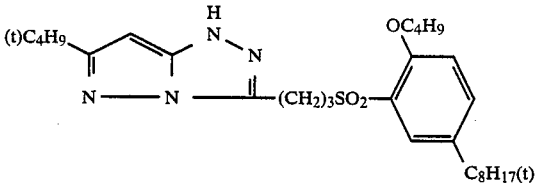
22
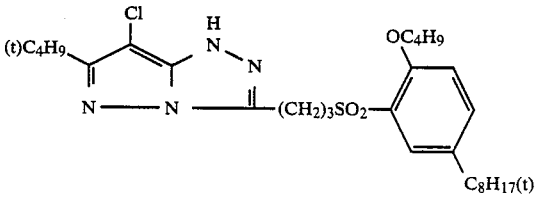
23
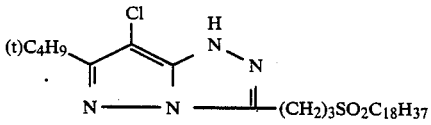
24
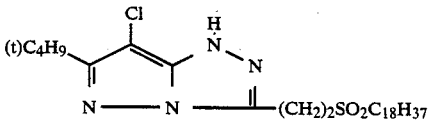
25
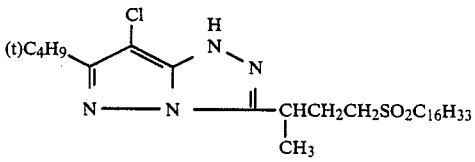
26
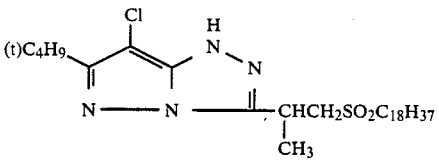

-continued
27
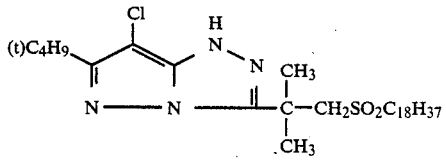
28
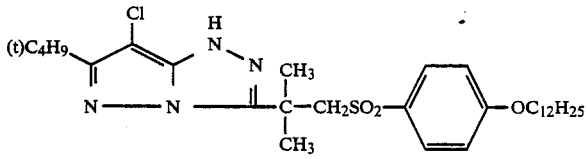
29
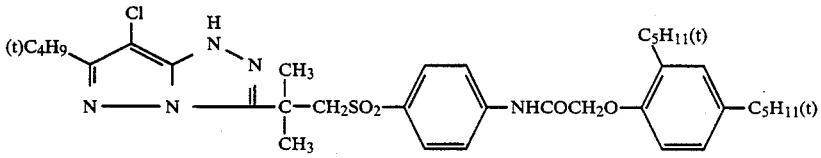
30
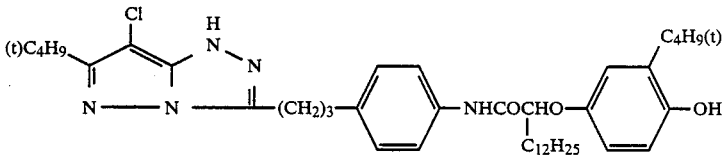
31
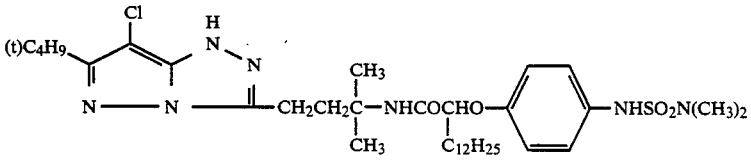
32
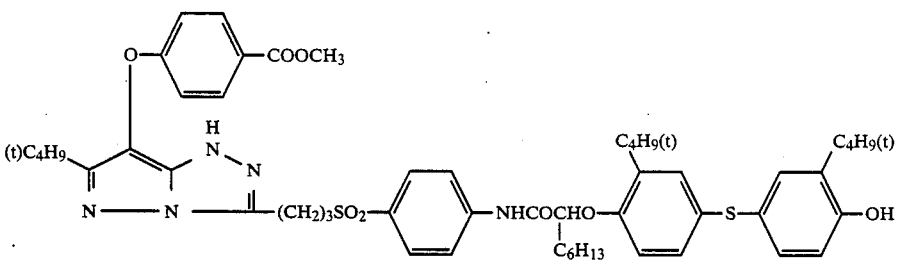
33
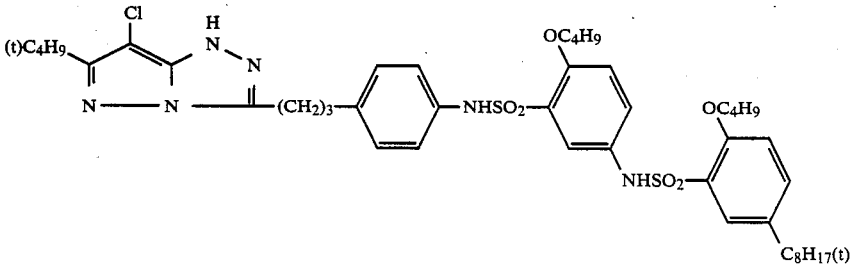
34
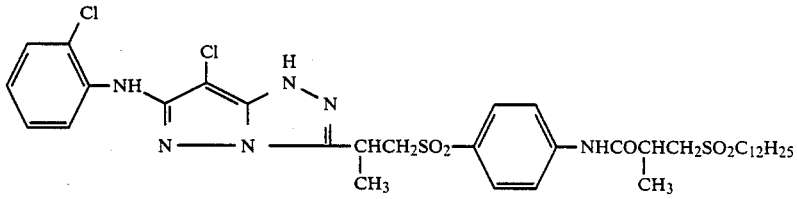

-continued
35
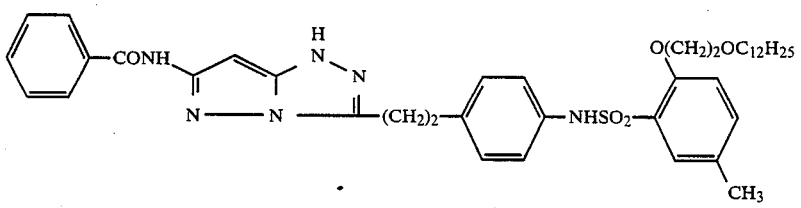
36
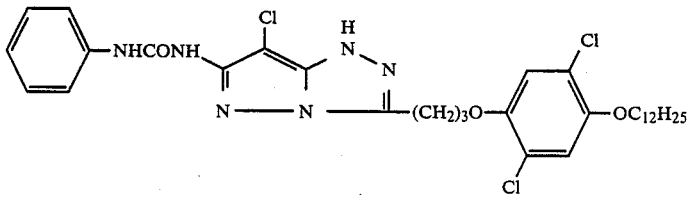
37
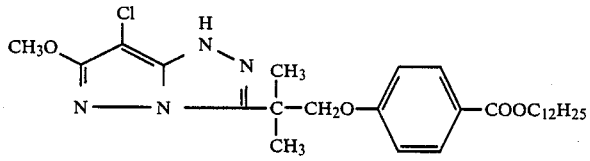
38
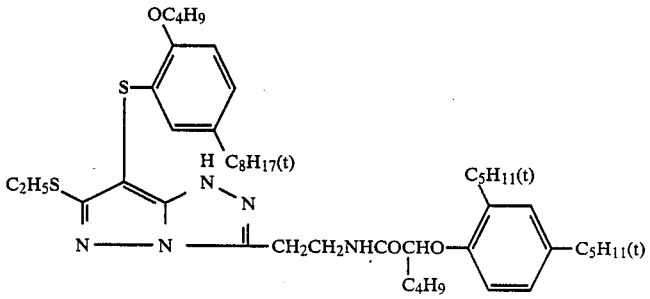
39
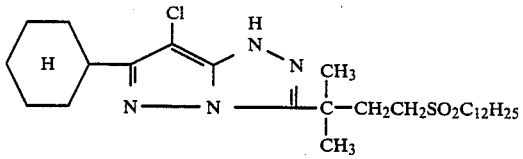
40
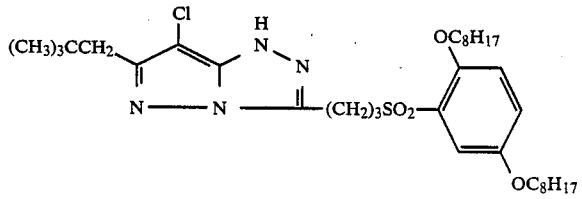
41
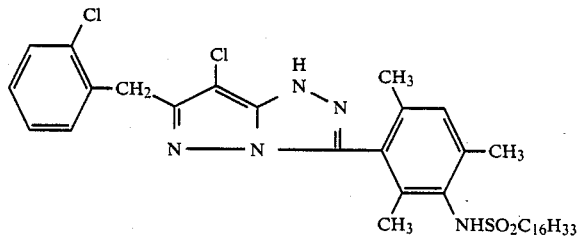

-continued
42
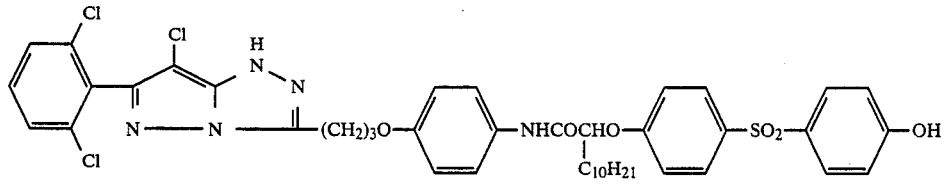
43
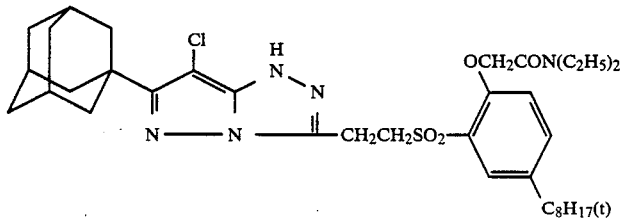
44
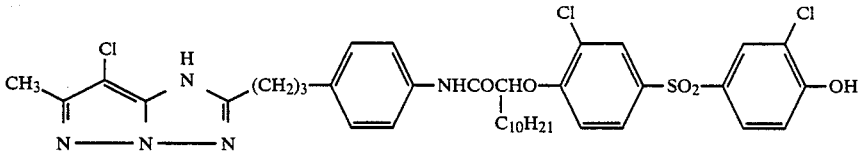
45
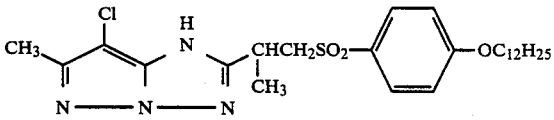
46
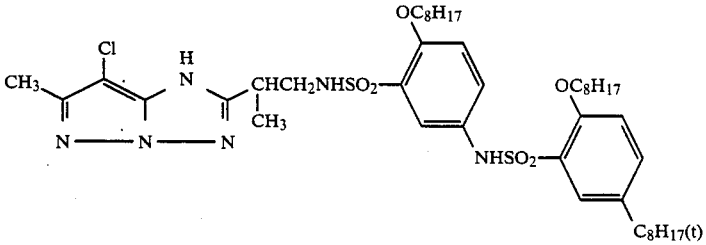
47
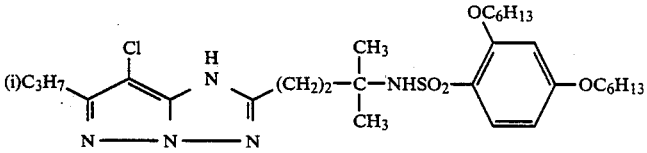
48
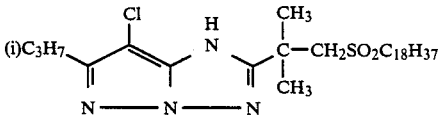
49
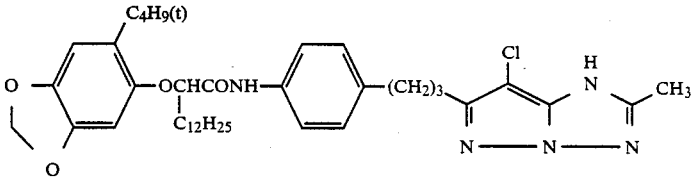

-continued
50
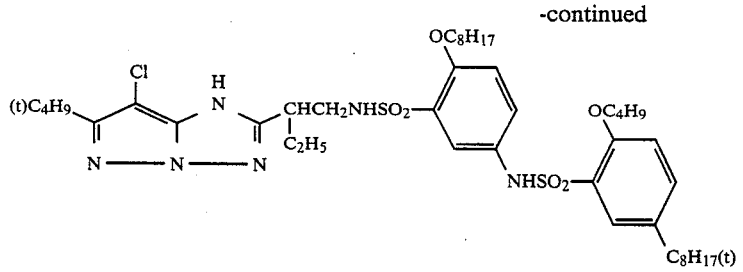
51
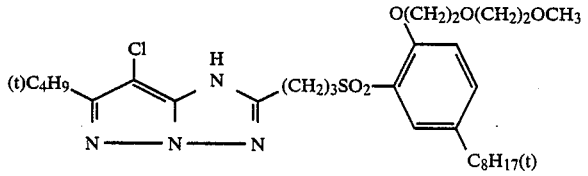
52
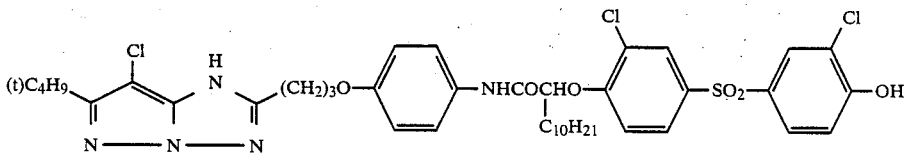
53
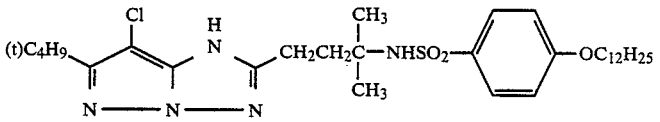
54
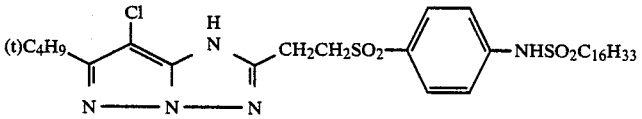
55
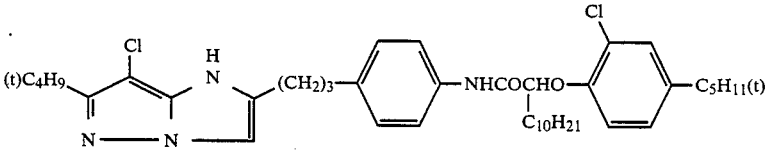
56
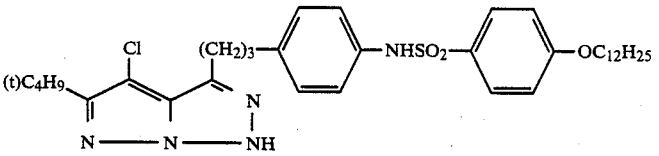
57
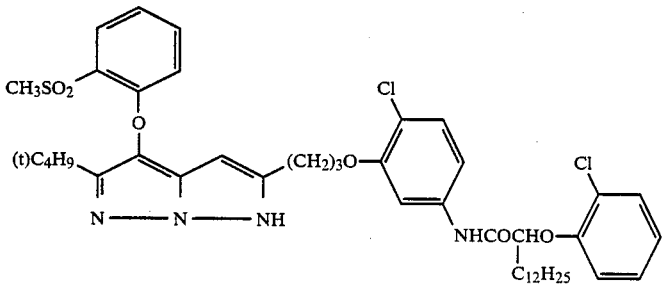
58
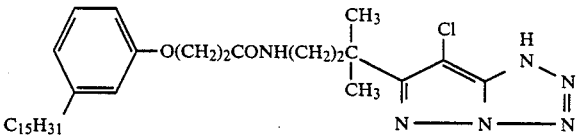

-continued

59

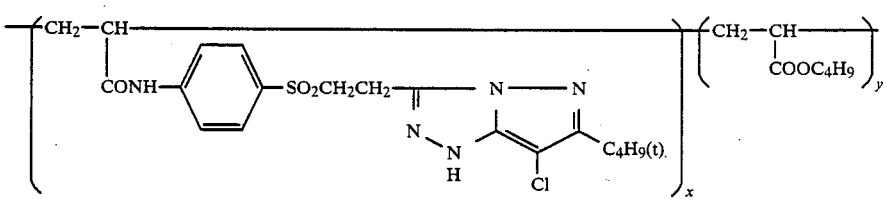

x:y = 50:50

60

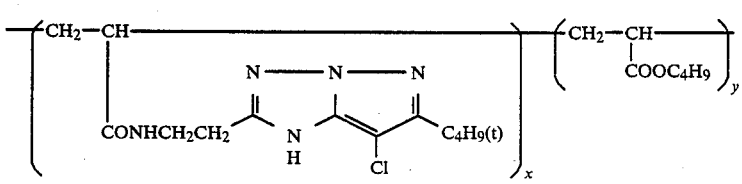

x:y = 50:50

In addition to the above typical examples of the magenta couplers according to the present invention, examples of the magenta couplers according to the present invention may also include the magenta couplers shown as Nos. 1 to 4, 6, 8 to 17, 19 to 24, 26 to 43, 45 to 59, 61 to 104, 106 to 121, 123 to 162 and 164 to 223 among the compounds described at pages 66 to 122 of the specification of Japanese Patent O.P.I. Publication No. 166339/1987.

The magenta couplers represented by the above Formula (M-I) (hereinafter referred to as the magenta couplers of the present invention) could be readily synthesized by a person skilled in the art, making reference to Journal of the Chemical Society, Perkin I (1977), 2047–2050, U.S. Pat. No. 3,725,067, Japanese Patent O.P.I. Publications No. 99437/1984, No. 42045/1983, No. 162548/1984, No. 171956/1984, No. 33552/1985, No. 43659/1985, No. 172982/1985 and No. 190779/1985, etc.

The magenta couplers of the present invention can be used usually in the range of from $1\times10^{-3}$ mol to 1 mol, preferably from $1\times10^{-2}$ mol to $8\times10^{-1}$ mol, per mol of silver halide contained in the emulsion layer.

The magenta couplers of the present invention can also be used in combination with magenta couplers of different kind.

In the present invention, the metal complexes represented by Formula (XI) and Formula (XII) may be used alone by selecting any one of them, or in combination by selecting two or more kinds from any one of the compounds represented by the respective formulas or selecting respectively one or more kinds from the compounds represented by the respective formulas. The object of the present invention can be sufficiently achieved in any of the cases.

$X^1$ in Formulas (XI) and (XII) may be the same with or different from each other, and each represent an oxygen atom, a sulfur atom or —$NR^{10}$—($R^{10}$ represents a hydrogen atom; an alkyl group as exemplified by a methyl group, an ethyl group, a n-propyl group, an i-propyl group, a n-butyl group, a t-butyl group, an i-butyl group and a benzyl group; an aryl group as exemplified by a phenyl group, a tolyl group and a naphthyl group; or a hydroxyl group). Preferably they each are an oxygen atom or a sulfur atom, more preferably an oxygen atom.

$X^2$ in Formula (XII) represents a hydroxyl group or a mercapto group, but may preferably be a hydroxyl group.

Y in Formulas (XI) and (XII) (which is present in the number of two in Formula (XII) but may be the same with or different from each other) represents an oxygen atom or a sulfur atom, but may preferably be a sulfur atom.

In Formulas (XI) and (XII), $R^1$, $R^2$ and $R^3$ each represent a hydrogen atom; an alkyl group as exemplified by a straight-chain or branched alkyl group having 1 to 20 carbon atoms, such as a methyl group, an ethyl group, a n-propyl group, a n-butyl group, a n-octyl group, a t-octyl group and a n-hexadecyl group; or an aryl group as exemplified by a phenyl group and a naphthyl group, but may preferably be an alkyl group.

The substituent represented by $R^4$ and $R^5$ in Formulas (XI) and (XII) may include an alkyl group as exemplified by a straight-chain or branched alkyl group having 1 to 20 carbon atoms, such as a methyl group, an ethyl group, a n-propyl group, a n-butyl group, a n-octyl group, a t-octyl group and a n-hexadecyl group; an aryl group as exemplified by a phenyl group and a naphthyl group; an alkoxy group as exemplified by a straight-chain or branched alkyloxy group such as a methoxy group, a n-butoxy group and t-butoxy group; an aryloxy group as exemplified by a phenoxy group; an alkoxycarbonyl group as exemplified by a straight-chain or branched alkyloxycarbonyl group such as a n-pentyloxycarbonyl group, a t-pentyloxycarbonyl group, a n-octyloxycarbonyl group and a t-octyloxycarbonyl group; an aryloxycarbonyl group as exemplified by a phenoxycarbonyl group; an acyl group as exemplified by a straight-chain or branched alkylcarbonyl group such as an acetyl group and a stearoyl group; an acylamino group as exemplified by a straight-chain or branched alkylcarbonylamino group such as an acetamido group, and an arylcarbonylamino group such as a benzoylamino group; an arylamino group as exemplified by a N-phenylamino group, an alkylamino group as exemplified by straight-chain or branched alkylamino group such as a N-n-butylamino group and a N,N-diethylamino group; a carbamoyl group as exemplified by straight-chain or branched alkylcarbamoyl group such as a n-butylcarbamoyl group; a sulfamoyl group as exemplified by straight-chain or branched alkylsulfamoyl group such as a N,N-di-n-butylsulfamoyl group and a N-n-dodecylsulfamoyl group; a sulfonamido group as exemplified by a straight-chain or branched alkylsulfonylamino group such as a methylsulfonylamino group, and an arylsulfonylamino group such as a phenylsulfonylamino group; a sulfonyl group as exemplified by a straight-chain or branched alkylsulfonyl group such as a mesyl group, and an arylsulfonyl group such as a tosyl group; or a cycloalkyl group as exemplified by a cyclohexyl group. Any of $R^4$ to $R^7$ adjacent each other may undergo ring closure to form a ring of 5 members or 6 members as exemplified by a benzene ring. Among $R^4$ and $R^5$, preferred is an alkyl group.

$R^6$ and $R^7$ each are a substituent having the value of $\sigma p$ as described in Hamett, "Physical Organic Chemistry", MacGraw-Hill Book Co., New York (1940), of not more than −0.25. Specifically they each represent an alkoxy group as exemplified by a straight-chain or branched alkyloxy group having 1 to 20 carbon atoms, such as a methoxy group, a n-butoxy group, a n-hexyloxy group, a n-octyloxy group, a t-octyloxy group and a benzyloxy group; a cycloalkyloxy group as exemplified by a cyclopentyloxy group and a cyclohexyloxy group; an alkylamino group as exemplified by an ethylamino group, a diethylamino group, a dibutylamino group, a t-butylamino group and an octylamino group; an arylamino group as exemplified by a phenyl amino group, a diphenylamino group and a naphthylamino group; or an alkylureido group as exemplified by an ethylureido group, a butylureido group, a dibutylureido group and an octylureido group. They, however, are by no means limited to these. Among these, preferred are the alkyloxy group and the alkylamino group.

On the substituents represented by $R^1$ to $R^8$, any of the following substotients may be substituted, as exemplified by an alkoxy group, an aryloxy group, an alkoxycarbonyl group, an aryloxycarbonyl group, an acyl group, an acylamino group, an arylamino group, an alkylamino group, a carbamoyl group, a sulfamoyl group, a sulfonamido group, a sulfonyl group a cycloalkyl group.

M in Formulas (XI) and (XII) represents a metal atom, preferably a nickel atom, a copper atom, a cobalt atom, a palladium atom or a platinum atom, among which most preferred is a nickel atom.

Examples of the typical metal complexes according to the present invention are shown below, but the present invention is by no means limited by these.

1.

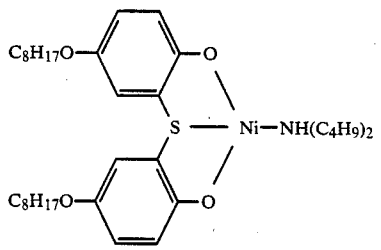

-continued

2.

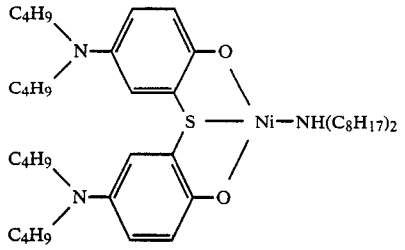

3.

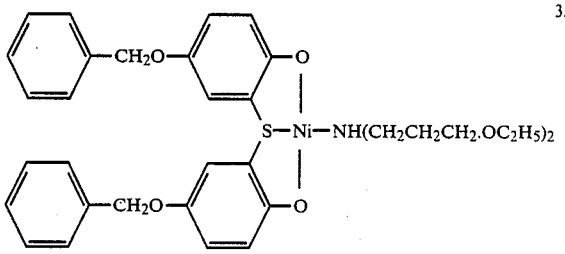

4.

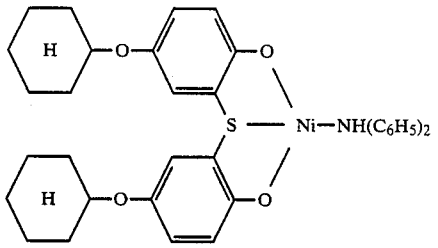

5.

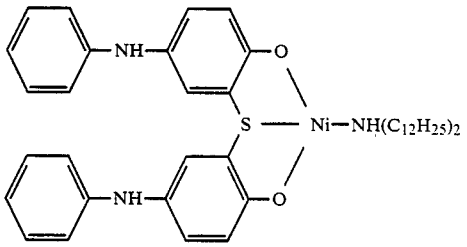

6.

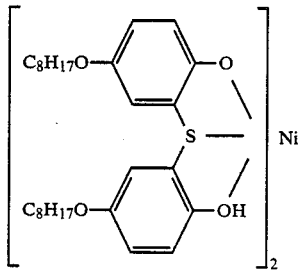

7.

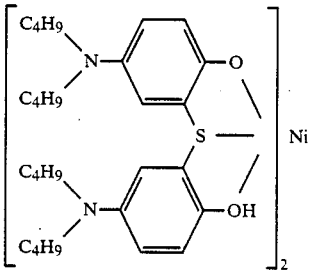

-continued

8.

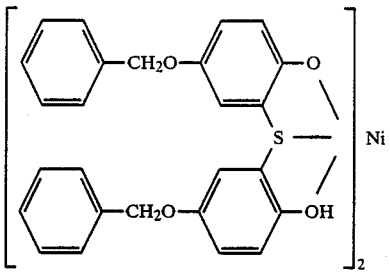

9.

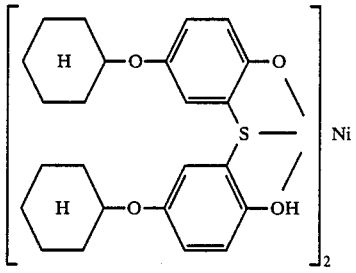

10.

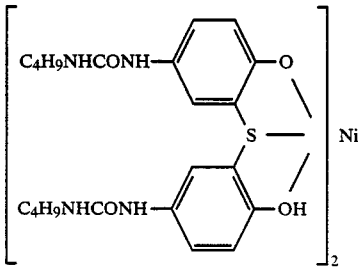

11.

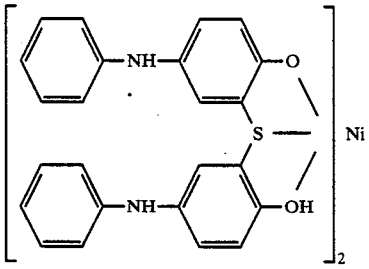

12.

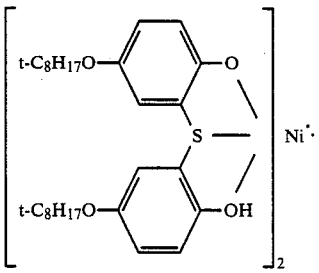

-continued

13.

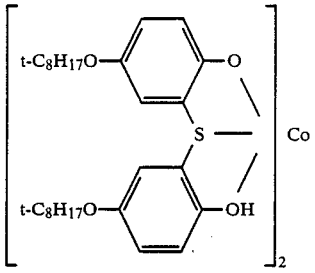

14.

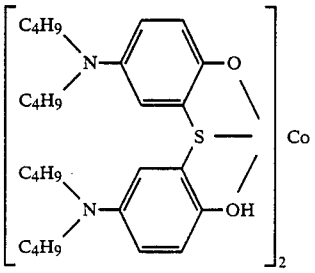

15.

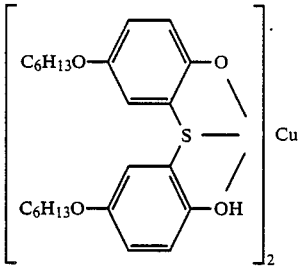

16.

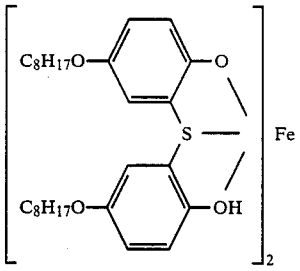

These complexes can be synthesized by the methods described in British Patent No. 858,890, West German patent application Publication No. 20 42 652, etc.

The compound represented by Formula (XI) of (XII) used as a magenta dye image stabilizer in the present invention, hereinafter referred to as the magenta dye image stabilizer of the present invention, may preferably be used in an amount of from 5 to 300 mol %, more preferably from 10 to 200 mol %, based on the magenta coupler of the present invention.

The magenta coupler of the present invention and the magenta dye image stabilizer of the present invention should preferably be used in the same layer, but the stabilizer may be used in a layer contiguous to a layer in which the coupler is present.

Hydrophobic compounds such as the magenta coupler of the present invention and the magenta dye image stabilizer of the present invention can be added in silver halide photographic light-sensitive materials with use of a variety of methods such as a solid dispersion method, a latex dispersion method and an oil-in-water type emulsion dispersion method. The oil-in-water type emulsion dispersion method, for example, may be carried out by dissolving hydrophobic additives such as magenta couplers usually in a high-boiling organic solvent having a boiling point of 150° C. or more, optionally using a low-boiling and/or water-soluble organic solvent in combination, and subjecting the resulting solution to emulsification dispersion in a hydrophilic binder such as an aqueous gelatin solution with use of a surface active agent, followed by addition in an intended hydrophilic colloid layer.

In the silver halide photographic light-sensitive material of the present invention, magenta dye image stabilizers described at pages 106 to 120 of the specification of Japanese Patent O.P.I. Publication No. 43146/1987, i.e., a phenol compound or phenyl ether compound represented by Formula (XIII) in that specification, can also be used in combination in addition to the magenta dye image stabilizer of the present invention.

Shown below are examples of the phenol compounds and phenyl ether compounds preferably used in combination in the magenta dye image stabilizer of the present invention.

PH-1

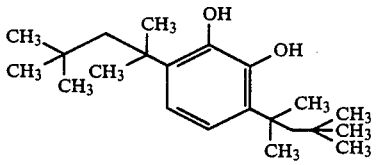

PH-2

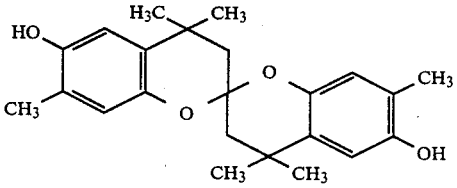

PH-3

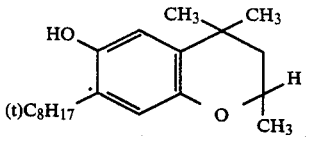

PH-4

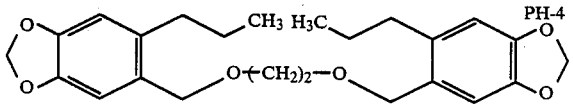

PH-5

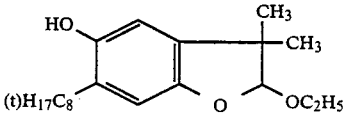

PH-6

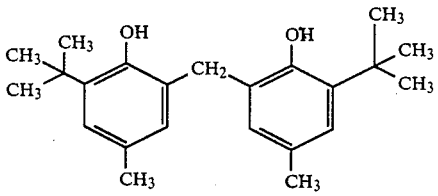

-continued

PH-7

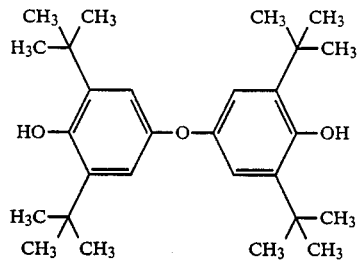

PH-8

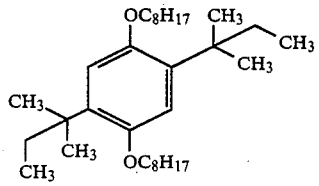

PH-9

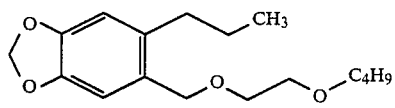

PH-10

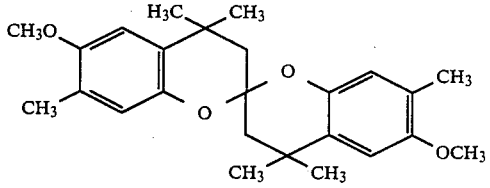

PH-11

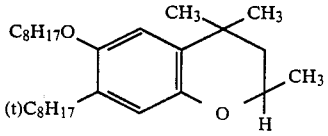

PH-12

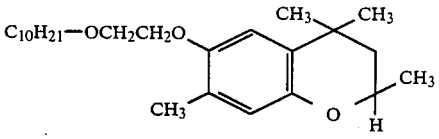

PH-13

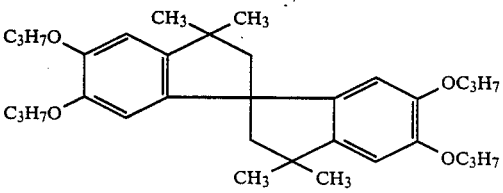

PH-14

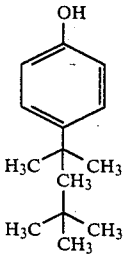

-continued

PH-15

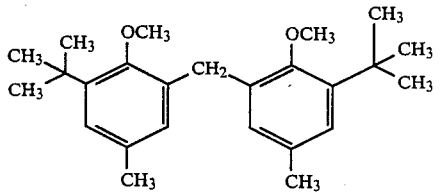

PH-16

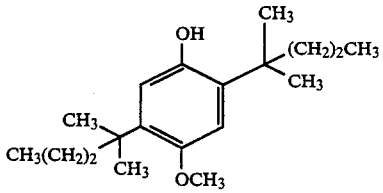

PH-17

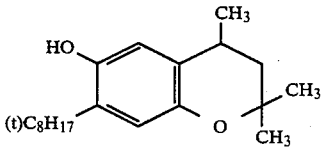

PH-18

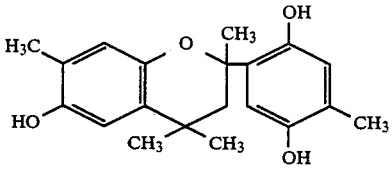

In the case when this phenol compound or phenyl ether compound is used in combination, it should preferably be used in an amount of 200 mol % or less, more preferably 140 mol % or less, based on the magenta dye image stabilizer of the present invention.

The silver halide photographic light-sensitive material of the present invention can be applied in color negative films, color positive films, color photographic paper, etc., but the effect of the present invention can be effectively exhibited particularly when applied in color photographic paper used for direct viewing.

The silver halide photographic light-sensitive material of the presnet invention including this color photographic paper may be either for use in monocolor or multicolor. In the case of the silver halide photographic light-sensitive material for use in multicolor, where a substractive color process is carried out for the color-reproduction, the light-sensitive material has the structure that silver halide emulsion layers usually containing the respective magenta, yellow and cyan couplers as couplers for photographic use and non-light-sensitive layers are laminated on a support in appropriate layer number and layer order. The layer number and layer order, however, may be appropriately changed depending on what performances are important and what purpose the light-sensitive material is used for.

Usable as the yellow coupler are a benzoylacetanilide compound, a pivaloylacetanilide compound, etc. Examples thereof are those described in U.S. Pat. Nos. 2,875,057, 3,265,506, 3,408,194, 3,551,155, 3,582,322, 3,725,072 and 3,891,445, West German Patent No. 15 47 868, West German patent application Publications Nos. 22 19 917, 22 61 361 and 24 14 006, British Patent No. 1,425,020, Japanese Patent Examined Publication No. 10783/1976, Japanese Patent O.P.I. Publications Nos. 26133/1972, 73147/1973, 102636/1976, 6341/1975, 123342/1975, 130442/1975, 21827/1976, 87650/1975, 82424/1977 and 115219/1977, etc.

Usable as the cyan coupler are a phenol compound, a naphthol compound, etc. Examples thereof are those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German patent application Publications (OLS) No. 24 14 830 and 24 54 329, Japanese Patent O.P.I. Publication Nos. 59838/1973, 26034/1976, 5055/1973, 146828/1976, 69624/1977 and 90932/1977.

In the silver halide emulsion used in the silver halide photographic light-sensitive material of the present invention (hereinafter referred to as the silver halide emulsion of the present invention), any of silver bromide, silver iodobromide, silver iodochloride, silver chlorobromide, silver chloride and so forth can be used as silver halides.

The silver halide emulsion of the present invention are chemically sensitized according to sulfur sensitization, selenium sensitization, reduction sensitization, noble metal sensitization, etc.

The silver halide emulsion of the present invention can be optically sensitized using a dye known in the photographic field as a sensitizing dye.

There can be optionally used in the silver halide photographic light-sensitive material of the present invention, anti-color-fogging agents, hardening agents, plasticizers, polymer latex, ultraviolet absorbents, formalin scavengers, mordants, development accelerators, development restrainers, brightening agents, matting agents, lubricants, antistatic agents, surface active agents, etc.

The silver halide photographic light-sensitive material of the present invention can form an image by subjecting it to various types of color development processing.

EXAMPLES

The present invention will be described below in greater detail by giving specific examples, but the present invention is by no means limited by these.

EXAMPLE 1

In a mixed solvent comprising 40 ml of dioctyl phthalate and 100 ml of ethyl acetate, 40 g of exemplary magenta coupler (1) previously shown were dissolved, and the resulting solution was added in 300 ml of an aqueous 5% gelatin solution containing sodium dodecylbenzenesulfonate, and thereafter dispersed by means of a homogenizer. The resulting dispersion was mixed into 500 g of a green-sensitive silver chlorobromide emulsion (Ag weight: 30 g), and a coating aid was added thereto to prepare a coating solution. Subsequently, this coating solution was coated on a polyethylene-coated paper support, and coated further thereon was a coating solution containing 2-(2'-hydroxy-3',5'-di-t-amylphenyl)-benzotriazole, gelatin, a spreading agent and a hardening agent, to provide a protective layer.

In this occasion, the 2-(2'-hydroxy-3',5'-di-t-amylphenyl)-benzotriazole and gelatin were coated so as to give coating weights of 5 mg/dm$^2$ and 15 mg/dm$^2$, respectively, to prepare a silver halide photographic light-sensitive material, which was designated as Sample 1.

Next, Sample 2 to Sample 7 were prepared in the same manner as in Sample 1 except that the dye-image stabilizer was added in the emulsion layer of Sample 1 in the combination as shown in Table 1.

These samples were subjected to optical wedge exposure with use of a sensitometer (KS-7 Type, available from Konica Corporation), followed by the following processing.

| Standard processing steps: | (Processing temp. and time) | |
|---|---|---|
| (1) Color developing | 38° C. | 3 min 30 sec |
| (2) Bleach-fixing | 33° C. | 1 min 30 sec |
| (3) Washing | 25 to 30° C. | 3 min |
| (4) Drying | 75 to 80° C. | about 2 min |

Composition of processing solutions:

| [Color developing tank solution] | |
|---|---|
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphate (TPPS) | 2.5 g |
| 3-Methyl-4-amino-N-(β-methanesulfonamidoethyl)-aniline sulfate | 5.5 g |
| Brightening agent (a 4,4'-diaminostilbensulfonic acid derivative) | 1.0 g |
| Potassium hydroxide | 2.0 g |
| Made up to 1 liter in total by adding water, and adjusted to pH 10.20. | |
| [Bleach-fixing tank solution] | |
| Ferric ammonium ethylenediaminetetraacetate dihydrate | 60 g |
| Ethylenediaminetetraacetic acid | 3 g |
| Ammonium thiosulfate (a 70% solution) | 100 ml |
| Ammonium sulfite (a 40% solution) | 27.5 ml |
| Adjusted to pH 7.1 using potassium carbonate or glacial acetic acid, and made up to 1 liter in total by adding water. | |

After the processing, light-fastness of the samples obtained were measured in the following manner.

Light-Fastness Test

Measured was color fading rate ($D_o-D/D_o\times 100$, $D_o$: initial density 1.0, D: density after color-fading) observed when dye images formed on the respective samples were exposed to irradiation of sunlight for 400 hours using an underglass outdoor exposure stand. Results obtained are shown in Table 1.

TABLE 1

| Sample No. | Dye-image stabilizer | | σ p value of $R^6$ and $R^7$ | Color-fading rate |
|---|---|---|---|---|
| 1 (X) | — | | — | 95 |
| 2 (X) | Comparative 1 | (0.4) | — | 83 |
| 3 (X) | Comparative 1 | (0.4) | approx. −0.20 | 43 |
| 4 (Y) | 3 | (0.4) | approx. −0.24 | 39 |
| 5 (Y) | 4 | (0.4) | approx. −0.34 | 38 |
| 6 (Y) | 6 | (0.4) | approx. −0.34 | 36 |
| 7 (Y) | 7 | (0.4) | approx. −0.38 | 35 |

Numerical values in the parentheses indicate molar ratio to the coupler.
X: Comparative example
Y: Present invention Comparative 1:

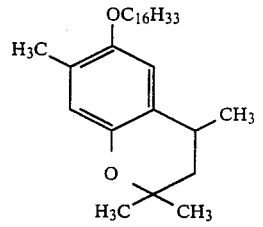

Comparative 2:

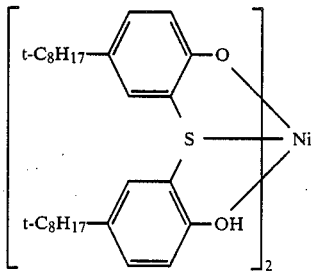

As will be clear from Table 1, the metal complexes according to the present invention show a greater color-fading preventive effect ot the magenta coupler of the present invention as compared with the conventional antioxidant, Comparative 1. They also show color-fading preventive effect that can not be obtained by Comparative 2.

Comparative 2 has the same chemical structure as the compound represented by Formula XII except that it has tOoctyl groups as the substituents respectively represented by $R^6$ and $R^7$. Value of p of t-octyl group is without the claimed value of the invention.

EXAMPLE 2

On a polyethylene-coated paper support, the following respective layers were provided by coating in succession from the support side to prepare a silver halide photographic light-sensitive material for use in multicolor.

First Layer: Blue-Sensitive Silver Chlorobromide Emulsion Layer

Provided by coating so as to give coating weights of 8 mg/dm² for α-pivalyl-α-(1-benzyl-2,4-dioxoimidazolidin-3-yl)2-chloro-5-[γ-(2,4-di-t-amylphenoxy)-butylamido]acetanilide as a yellow coupler, 3 mg/dm² for a blue-sensitive silver chlorobromide emulsion calculated as silver, 3 mg/dm² for 2,4-di-t-butylphenol-3',5'-di-t-amyl-4'-hydroxybenzoate, 3 mg/dm² for dioctyl phthalate, and 16 mg/dm² for gelatin.

Second Layer: Intermediate Layer

Provided by coating so as to give a coating weight of 4 mg/dm² for gelatin.

Third Layer: Green-Sensitive Silver Chlorobromide Emulsion Layer

Provided by coating so as to give coating weights of 4 mg/dm² for exemplary magenta coupler (26) previously shown, 2 mg/dm² for a green-sensitive silver chlorobromide emulsion, calculated as silver, 4 mg/dm² for dioctyl phthalate, and 16 mg/dm² for gelatin.

Fourth Layer: Intermediate Layer

Provided by coating so as to give coating weights of 3 mg/dm$^2$ for 2-(2'-hydroxy-3',5'-di-t-amylphenyl)-benzotriazole and 3 mg/dm$^2$ for 2-(2'-hydroxy-3',5'-di-t-butylphenyl)-benzotriazole as ultraviolet absorbents, 4 mg/dm$^2$ for dioctyl phthalate, and 16 mg/dm$^2$ for gelatin.

Fifth Layer: Red-Sensitive Silver Chlorobromide Emulsion Layer

Provided by coating so as to give coating weights of 1 mg/dm$^2$ for 2,4-dichloro-3-methyl-6-[α-(2,4-di-t-amylphenoxy)butylamido]-phenol and 3 mg/dm$^2$ for 2-(2,3,4,5,6-pentafluorophenyl)acylamino-4-chloro-5-[α-(2,4-di-t-amylphenoxy)pentylamido]-phenol as cyan couplers, 2 mg/dm$^2$ of dioctyl phthalate, and 3 mg/dm$^2$ for a red-sensitive silver chlorobromide emulsion, calculated as silver.

Sixth Layer: Intermediate Layer

Provided by coating so as to give coating weights of 2 mg/dm$^2$ for 2-(2'-hydroxy-3',5'-di-t-amylphenyl)-benzotriazole and 2 mg/dm$^2$ for 2-(2'-hydroxy-3',5'-di-t-butylphenyl)-benzotriazole as ultraviolet absorbents, 2 mg/dm$^2$ for dioctyl phthalate, and 6 mg/dm$^2$ for gelatin.

Seventh Layer: Protective Layer

Provided by coating so as to give a coating weight of 9 mg/dm$^2$ for gelatin.

The sample thus obtained is designated as Sample 8.

Next, Sample 9 to Sample 27 were prepared in the same manner as in Sample 8 except that the dye-image stabilizer was added in the third layer of Sample 1 in the combination as shown in Table 1.

The samples thus obtained were subjected to the same exposure treatment as in Example 1. Provided that the optical wedge exposure was carried out using green light to obtain samples that are monochromatic in magenta. After the treatment, the light-fastness of magenta dye images was tested on the resulting respective samples in the same manner as in Example 1.

To examine color purity of the magenta color-formed samples, also carried out was measurement on spectrums of spectral reflection density in the following manner.

Measurement on Spectrums of Spectral Reflection Density of Magenta Color-Formed Samples Spectruum of spectral reflection at the magenta color-formed area of each sample was measured using a color analyzer Type 607 (available from Hitachi, Ltd.). In this occasion, measurement was made by standardizing as 1.0 the maximum density of the absorption spectrum at the visible region of each sample.

The reflection density at 420 nm of each sample was regarded as secondary absorption density serving as a standard for the color purity.

To examine Y-stains at non-image portions, measurement was also made in the following manner.

Measurement of Y-Stains

Spectral reflection density was measured using a color analyzer Type 607 (available from Hitachi, Ltd.) on the basis of the value obtained by subtracting Y-stain density observed before light-fastness testing, from Y-stain density observed after light-fastness testing on each sample.

Results obtained are shown in Table 2.

TABLE 2

| Sample No. | Magenta coupler | Dye-image stabilizer | Color-fading rate, % | Secondary absorption density | Y-stain |
|---|---|---|---|---|---|
| 8 (X) | 26 | — | 92 | 0.19 | 0.02 |
| 9 (X) | 26 | Comparative 1 | 83 | 0.19 | 0.05 |
| 10 (X) | 26 | Comparative 2 | 9 | 0.20 | 0.07 |
| 11 (Y) | 26 | 4 | 8 | 0.19 | 0.04 |
| 12 (Y) | 26 | 6 | 7 | 0.19 | 0.04 |
| 13 (Y) | 26 | 7 | 6 | 0.20 | 0.05 |
| 14 (X) | 3 | — | 95 | 0.19 | 0.02 |
| 15 (X) | 3 | Comparative 2 | 39 | 0.20 | 0.07 |
| 16 (Y) | 3 | 6 | 34 | 0.19 | 0.04 |
| 17 (X) | 10 | — | 94 | 0.19 | 0.02 |
| 18 (X) | 10 | Comparative 2 | 18 | 0.20 | 0.07 |
| 19 (Y) | 10 | 6 | 16 | 0.19 | 0.04 |
| 20 (X) | 46 | — | 97 | 0.20 | 0.03 |
| 21 (X) | 46 | Comparative 2 | 45 | 0.21 | 0.08 |
| 22 (Y) | 46 | 6 | 39 | 0.20 | 0.05 |
| 23 (X) | 50 | — | 94 | 0.20 | 0.03 |
| 24 (X) | 50 | Comparative 2 | 18 | 0.20 | 0.08 |
| 25 (Y) | 50 | 6 | 16 | 0.20 | 0.05 |
| 26 (X) | CMC* | — | 60 | 0.37 | 0.15 |
| 27 (X) | CMC* | 7 | 41 | 0.37 | 0.20 |

X: Comparative Example,
Y: Present invention
*Comparative magenta coupler

Comparative magenta coupler:

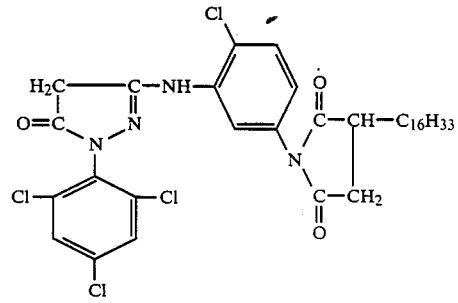

Comparative 1 and Comparative 2 are the same as those in Example 1.

As will be clear from Table 2, the combination of the metal complex according to the present invention and the magenta coupler according to the present invention is seen to bring about greater effect of improving the light-fastness as compared with the combination with Comparative 1 or Comparative 2, and also as compared with the combination of the metal complex according to the present invention with the comparative magenta coupler. This effect is seen to be particularly remarkable when the group represented by R in the magenta coupler of Formula (I) according to the preset invention is a tertiary alkyl group. This fact was recognized to have been quite unexpected. The samples of the present invention also brought about magenta images having a good color purity and being in a good state of Y-stain.

According to the silver halide photographic light-sensitive material containing the magenta coupler and magenta dye image stabilizer of the present invention, it is possible to improve the fastness of the magenta dye images that have hitherto had small fastness, in particular, to light, heat and humidity, and, specifically, satisfactorily prevent the color-fading against light and the generation Y-stain at non-image portions against light, heat annd humidity.

What is claimed is:

1. A silver halide photographic light-sensitive material having at least one silver halide emulsion layer wherein said material comprises at least one coupler represented by the following Formula (M-1) and at least one compound selected from the group consisting of compounds represented by the following Formula (XI) and compounds represented by Formula (XII);

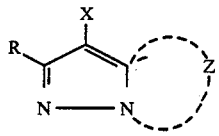

Formula (M-1)

wherein

Z represents a group of non-metal atoms necessary to complete a nitrogen-containing heterocyclic ring which may have a substituent;

X represents a hydrogen atom or a substituent capable of being split off upon reaction with the oxidized product of a color developing agent; and R represents a hydrogen atom or a substituent;

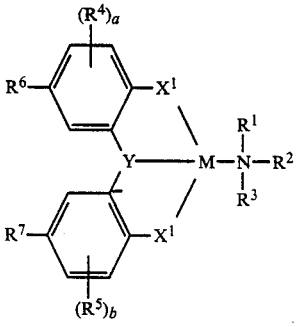

Formula (XI)

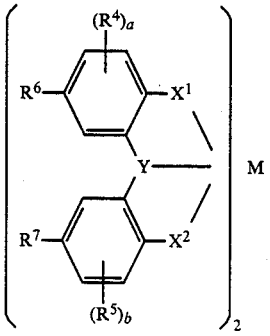

Formula (XII)

wherein $X^1$ is an oxygen, atom, a sulfur atom or an —$NR^{10}$— in which $R^{10}$ represents a hydrogen atom, an alkyl group, an aryl group or a hydroxyl group;

$X^2$ represents a hydroxyl group or a mercapto group;

Y represents an oxygen atom or a sulfur atom;

$R^1$, $R^2$ and $R^3$ each represent a hydrogen atom, an alkyl group or an aryl group, respectively, provided that at least two of the groups represented by $R^1$, $R^2$ and $R^3$ are an alkyl group or an aryl group;

$R^4$ and $R^5$ each represent a substituent;

$R^6$ and $R^7$ each represent a substituent having a $\sigma p$ value of not more than $-0.25$;

$R^4$, $R^5$, $R^6$ and $R^7$ adjacent each other may form a ring of five-members or six-members;

M represents a metal atom; and a and b each represent an integer of 0 to 3.

2. The material of claim 1, wherein said coupler is represented by the following Formula (M-VIII);

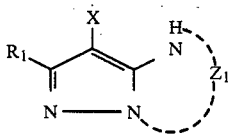

Formula (M-VIII)

wherein $R_1$, X and $Z_1$ are the same as R, X and Z defined in Formula (M-I), respectively.

3. The material of claim 1, wherein an amount of said coupler is within the range of from $1\times10^{-3}$ mol to 1 mol per mol of silver halide contained in said emulsion layer.

4. The material of claim 3, wherein an amount of said coupler is within the range of from $1\times10^{-2}$ mol to $8\times10^{-1}$ mol per mol of silver halide contained in said emulsion layer.

5. The material of claim 1, wherein said $X^1$ in Formula (XI) and Formula (XII) represents an oxygen atom.

6. The material of claim 1, wherein said $R^6$ and $R^7$ in Formula (XI) and Formula (XII) each represent an alkyloxy group, a cycloalkyloxy group, an alkylamino group, an arylamino group or an alkylureido group.

7. The material of claim 6, wherein said $R^6$ and $R^7$ each represent an alkyloxy group or an alkylamino group.

8. The material of claim 1, wherein said M in Formula (XI) and Formula (XII) represents a nickel atom, a copper atom, a cobalt atom, palladium atom or a platinum atom.

9. The material of claim 8, wherein said M represents a nickel atom.

10. The material of claim 1, wherein an amount of said compound represented by Formula (XI) or Formula (XII) is within the rage of from 5 mol % to 300 mol % to said coupler.

11. The material of claim 10, wherein an amount of said compound represented by Formula (XI) or Formula (XII) is within the range of from 10 mol % to 200 mol % to said coupler.

* * * * *